US008162602B2

(12) United States Patent
Caucheteux et al.

(10) Patent No.: US 8,162,602 B2
(45) Date of Patent: Apr. 24, 2012

(54) TURBOMACHINE CASING INCLUDING A DEVICE FOR PREVENTING INSTABILITY DURING CONTACT BETWEEN THE CASING AND THE ROTOR

(75) Inventors: Mathieu Caucheteux, Creteil (FR); Francois Maurice Garcin, Paris (FR); Jean-Pierre Francois Lombard, Pamfou (FR); Nicolas Christian Triconnet, Saint Fargeau Ponthierry (FR)

(73) Assignee: SNECMA, Paris (FR)

( * ) Notice: Subject to any disclaimer, the term of this patent is extended or adjusted under 35 U.S.C. 154(b) by 730 days.

(21) Appl. No.: 12/428,140

(22) Filed: Apr. 22, 2009

(65) Prior Publication Data

US 2009/0297331 A1 Dec. 3, 2009

(30) Foreign Application Priority Data

Apr. 23, 2008 (FR) ..... 08 52717

(51) Int. Cl.
*F04D 29/44* (2006.01)
*F04D 29/54* (2006.01)

(52) U.S. Cl. ..... 415/200; 415/115; 416/214 A; 416/216; 416/237

(58) Field of Classification Search ..... 415/115, 415/119, 126, 129, 137, 200, 173.1; 416/216, 416/214 A, 237
See application file for complete search history.

(56) References Cited

U.S. PATENT DOCUMENTS 3,319,929 A 5/1967 Lawrence et al.
5,064,013 A * 11/1991 Lenz ..... 180/65.225

FOREIGN PATENT DOCUMENTS

EP 1 016 792 A2 7/2000
EP 1 746 249 A2 1/2007
JP 2006-144575 6/2006

* cited by examiner

*Primary Examiner* — David Nhu
(74) *Attorney, Agent, or Firm* — Oblon, Spivak, McClelland, Maier & Neustadt, L.L.P.

(57) ABSTRACT

A cylindrical casing for a turbomachine that is suitable for receiving a rotor fitted with at least one bladed wheel is disclosed. The casing includes a device for preventing instability during contact between the casing and the bladed wheel. The device includes a succession of elements disposed around the circumference of the casing, and presenting different stiffnesses between two adjacent elements. The number of elements having the same stiffness not being equal to a multiple of the wave number of the vibratory mode of the bladed wheel that is to be inhibited. The invention is applicable to a compressor, a turbine, or a fan.

16 Claims, 2 Drawing Sheets

TURBOMACHINE CASING INCLUDING A DEVICE FOR PREVENTING INSTABILITY DURING CONTACT BETWEEN THE CASING AND THE ROTOR

CROSS-REFERENCE TO RELATED APPLICATIONS

This application claims priority to FR 0852717 filed on Apr. 23, 2008.

FIELD OF THE INVENTION

The invention relates to the field of rotor and stator assemblies for turbomachines, and in particular rotor and stator assemblies presenting small clearance, as are to be found in particular compressors, turbines, and fans of turbomachines, in particular airplane engines.

BACKGROUND OF THE INVENTION

In order to increase the efficiency of airplane engines, the clearance is reduced between the rotary portions formed by bladed wheels (or rotor stages) and the stationary portions surrounding them and constituted by casings that also support series of stationary vanes (or stator stages).

Nevertheless, this reduction in clearance increases the risk of contact being made between the moving blades of the bladed wheel and the facing casing segments, and some such contacts can lead to systems instabilities.

FIG. 1 shows such a casing 10 provided with a layer of abradable material 12 on its inside face, shown together with a bladed wheel 20 mounted in the housing defined by the casing 10.

Such contacts take place in particular at transient speeds as a result of local or continuous interference between the tip of a blade and the facing track of the casing. When such contact is made, it will be understood that the blades can be subjected to high levels of stress presenting a vibratory nature, and that under such circumstances they can be caused to vibrate in one of their resonant modes. Under such circumstances, the level of vibration increases very quickly, subjecting the blades concerned to deformations that are liable to exceed their endurance limit, thereby leading to degradation of the abradable tracks and to damage to the blades (blade tip heating, fatigue cracking, permanent deformation, . . . ) that can lead to blades breaking. As a general rule, the phenomenon is very short lived, either because some external event puts an end to it (change of speed of rotation of the rotor, thermal transient, . . . ), or else because the resonant frequency of the damaged blade is changed, thereby putting the system out of tune.

The phenomenon might involve a single blade, a set of blades, or the entire wheel, i.e. all of the blades, where the all-blade phenomenon occurs rarely, simply because of dispersions in blade length due to fabrication.

In general, in order to limit such damage, the leading edge and/or the trailing edge is offset so that contact does not take place in those locations but rather in zones where the blade is more robust: this is to the detriment of performance.

FR 2 869 069 discloses taking consideration of the vibratory phenomenon due to the blades of a bladed wheel and avoiding resonance phenomena by deliberately de-tuning the bladed wheel.

Nevertheless, under such circumstances, no account is taken of rotor and stator interactions, also known as "coupling phenomena", that occur between the vibratory modes of the bladed wheel and the vibratory modes of the assembly formed by the casing and the bladed wheel.

OBJECT AND SUMMARY OF THE INVENTION

An object of the present invention is to provide a solution that enables the drawback of the prior art to be overcome, in particular by making it possible to avoid any vibratory risk for the rotor and stator assembly.

To this end, according to the present invention, provision is made for the cylindrical casing of a turbomachine, facing a rotor fitted with at least one bladed wheel, to include a device that prevents instability during contact between the casing and the bladed wheel, said device comprising a succession of elements disposed along the circumference of the casing and presenting, between two adjacent elements, different stiffnesses, the numbers of elements having the same stiffness not being equal to a multiple of the wave number of the vibratory mode that is to be inhibited in the associated bladed wheel.

Such an anti-instability device is located on at least the segment that is to receive the bladed wheel, i.e. at the location of the circular track of the casing that faces the bladed wheel. It is equally possible to place the anti-instability device over the entire length of the casing, or merely over the segment that is to receive the bladed wheel.

In this way, it can be understood that according to the invention, the cyclical symmetry of the casing is broken so it no longer presents a series of sectors that are geometrically identical. The casing presents either an alternation of sectors of different stiffnesses or else an irregular succession of sectors of different stiffnesses.

This solution also presents the additional advantage of reducing any risk of the coupling phenomenon, merely by adapting the stator portion, and without having any effect on the nearby parts, in particular the rotor, the channels between blades, or the air flow channel, none of which are modified, so this solution can be applied to existing equipment.

Preferably, said anti-instability device has elements of a first type presenting a first stiffness and elements of a second type presenting a second stiffness different from the first stiffness. Under such circumstances, according to the invention, both the number of elements of the first type and the number of elements of the second type are not equal to a multiple of the wave number of the vibratory mode to be inhibited of the bladed wheel that is to be in register with the casing, or the corresponding casing segment.

The elements of the first type present a first angular sector dimension and the elements of the second type present a second angular sector dimension.

For reasons of simplicity in modeling and in construction, it is preferable for the first angular sector dimension and the second angular dimension to be identical, so that the elements of the first type and the elements of the second type present the same angular extent.

However, it is also possible to envisage a configuration in which the first angular sector of the invention and the second angular sector of the invention are different.

The present invention also applies to circumstances in which the anti-instability device includes, not only elements of the first type and elements of the second type, but also elements presenting some other stiffness, such that the anti-instability device comprises more than two different stiffnesses around the circumference of the casing.

Equally, the present invention relates to a rotor and stator assembly comprising a casing as described above having a device that prevents instability during contact between the casing and the bladed wheel, the casing forming the stator, said rotor and stator casing further including a bladed wheel forming the rotor.

Advantageously, in such a rotor and stator assembly, said bladed wheel is a one-piece bladed disk or a one-piece bladed ring.

The present invention also relates to an axial compressor for operating at low pressure, at intermediate pressure, or at high pressure, comprising for its stator a casing as described above having a device for preventing instability during contact between the casing and the bladed wheel, and also a turbomachine including such an axial compressor.

The present invention also relates to a centrifugal compressor comprising, as its stator, a casing as described above and including a device preventing instability during contact between the casing and the bladed wheel, and it also provides a turbomachine including such a centrifugal compressor.

The present invention also relates to a fan comprising, as its stator, a casing as described above, and including a device preventing instability during contact between the casing and the bladed wheel, and the invention also provides a turbomachine including such a fan.

The present invention also relates to a turbine, a high-pressure, a low-pressure, or intermediate-pressure turbine, including, as its stator, a casing as described above that includes a device for preventing instability during contact between the casing and the bladed wheel, and it also provides a turbomachine including such a turbine.

Finally, the invention relates to a method of preventing an instability occurring during contact in a stator and rotor assembly of a turbomachine, the method consisting in inhibiting at least one vibratory mode of a bladed wheel forming part of the rotor, wherein the method consists in arranging the casing, at least on the segment facing the bladed wheel, so that it presents angular sectors of different stiffnesses around its circumference, the number of same-stiffness angular sectors not being equal to a multiple of the wave number of the vibratory mode of the wheel that is to be inhibited.

Overall, by the solution of the present invention, it is possible to create azimuthal asymmetry in the stiffness of the casing, which asymmetry is selected so as to inhibit the desired vibratory mode of the bladed wheel forming part of the rotor, for the purpose of preventing any phenomenon of coupling between the rotor and the stator.

BRIEF DESCRIPTION OF THE DRAWINGS

Other advantages and characteristics of the invention appear on reading the following description made by way of example and with reference to the accompanying drawings, in which.

MORE DETAILED DESCRIPTION

Below, when applied to a circular system with cyclical symmetry, the terms "wave number" or "node diameter" or "phase shift index of a vibratory mode", designate the number of peaks or of troughs representing respectively positive and negative amplitude maxima in a radial direction of the wave in question. The number of nodes, i.e. the number of positions where the amplitude of the wave is zero, is twice the wave number.

By way of example, a wave having a wave number of three, corresponding to three node diameters, is a six-node wave.

Figure 3:
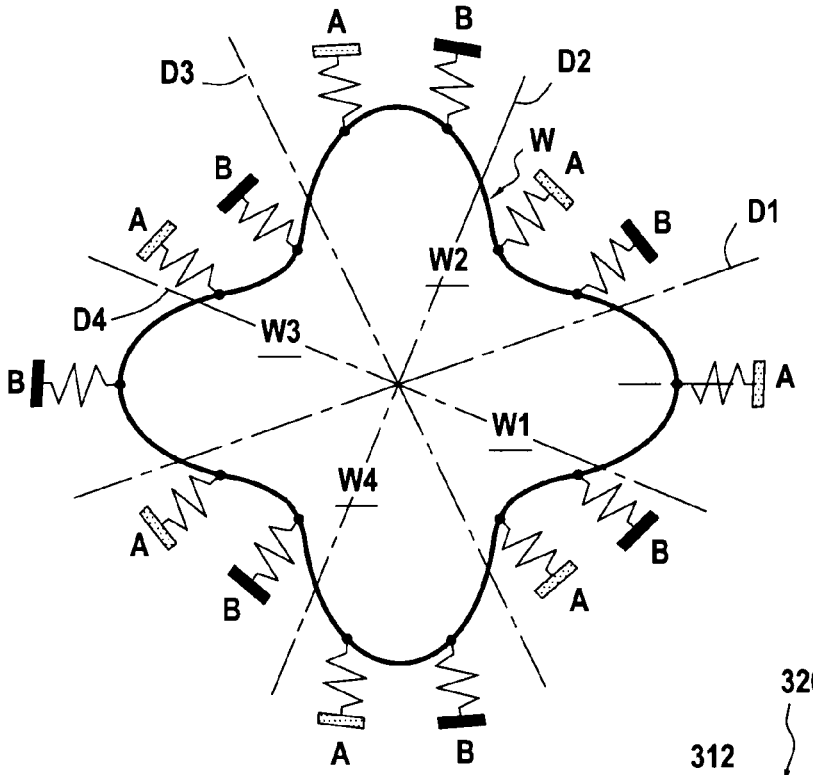
FIG. 3 is an azimuth view of a wave with a wave number equal to four, showing the correspondence with the distribution of the abradable materials of the FIG. 2 casing.

Thus, in FIG. 3, a wave W is shown in a cylindrical frame of reference (azimuth representation) and it presents four node diameters D1 to D4 that are shown in association with the eight vibration nodes situated between the four troughs and four peaks of the wave W. Thus, the wave W presents a wave number equal to four. The wave W is made up of four successive identical sinusoidal profiles: in FIG. 3, the four spatial periods W1 to W4 are defined by the diameters D1 and D3.

In order to illustrate the various embodiments of the present invention, a casing of the invention is selected that is provided with an anti-instability device made up of fourteen angular sectors of two types presenting two different stiffnesses and corresponding to a succession of fourteen elements, each of the same angular size, any two adjacent elements presenting different stiffnesses.

Thus, in accordance with the invention, seven (the number of elements or of angular sectors having the same stiffness in the anti-instability device) is not a multiple of four (the wave number of the wave W).

More precisely, for each of the three embodiments shown and described below, only two types of element are provided, referred to respectively as elements of a first type presenting first stiffness, and elements of a second type presenting second stiffness different from the first stiffness.

Figure 2:
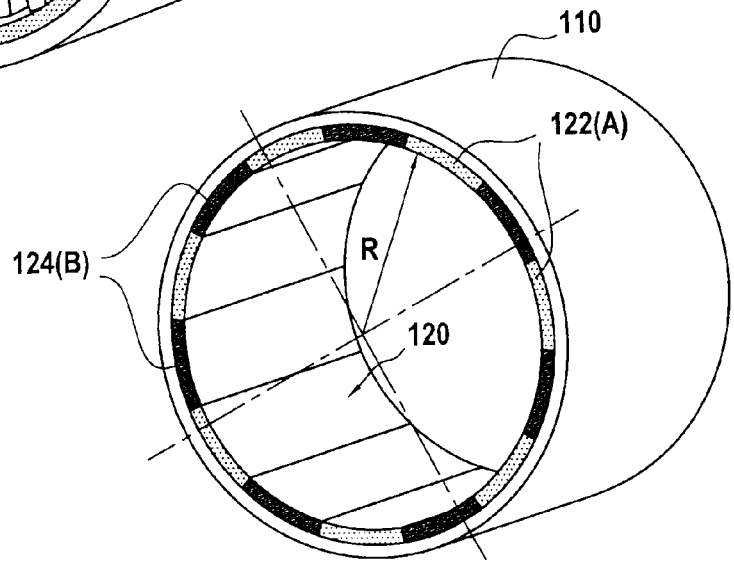
FIG. 2 is a perspective view of a casing for a first embodiment of the invention.

In a first embodiment, shown in FIG. 2, the invention consists in placing an anti-instability device 120 on the inside face of the casing 110, said anti-instability device comprising, in each angular sector, elements of the first type 122 and elements of the second type 124 that are constituted respectively by abradable material layers A and B having different Young's moduluses.

For reasons of simplicity, the elements of the first type 122 and the elements of the second type 124 shown here present the same thickness and cover the entire inside face of the casing, i.e. its entire circumference, and possibly extend axially beyond the segment corresponding to the bladed wheel 20 under consideration.

In practice, to form this sectorized abradable layer 120 made up of fourteen sectors, comprising seven sectors formed of elements of the first type 122 and made of a material A and seven sectors formed of elements of the second type 124 and made of a material B, use is made of materials A and B that are similar but in which the proportions of the materials making them up are varied so as to obtain different Young's moduluses, i.e. different stiffnesses.

It is also possible to use two materials A and B of different kinds in order to make the elements of the first type 122 out of a first material A and the elements of the second type 124 out of a second material B.

For example, the first material A may be a material of the Metco (registered trademark) type, i.e. obtained from a very fine powder made up of a polymer (such as polyethylene terephthalate (PET), for example) with grains covered in alumina and silica powder, together with a binder. This type of powder is generally plasma sprayed, the spraying vaporizing the PET, thereby leading to a porous deposit with a certain ability to withstand high temperature.

By way of example, the second material B may be a material of the RTV (registered trademark) type, namely a silicone rubber compound that withstands temperature variations since it is the result of polymerizing the compound under pressure in order to increase its density. Alternatively, the second material B may be a silastic (registered trademark), i.e. a silicone elastomer.

The techniques used for depositing this sectorized abradable layer 120 remain unchanged and they are naturally associated with the particular material(s) used.

For example, it is also possible to use an alloy based on nickel, molybdenum, and chromium, in particular of the Hastelloy (registered trademark) type, which alloy is deposited by plasma spraying, or by indeed by laser spraying (the powder is projected into a local melt bath generated by the laser beam).

This ends up providing a sectorized abradable layer 120 in which the radial distance R between the axis of the casing 110 and the inside face of the casing 110 coated with said layer is constant and substantially equal to the radius of the bladed wheel 20.

Consideration is given to circumstances in which the wave W is a wave that corresponds to one of the resonant modes of the bladed wheel 20, and consequently a wave that it is desired to inhibit.

If, as shown in FIG. 3, the wave W is associated with the casing 110 as shown in FIG. 2, then each spatial period of the wave is associated with a corresponding angular zone of the casing that presents different stiffness, because of the sectorized abradable layer 120.

Specifically, the first spatial period W1 of the wave W is associated with the first quarter of the circumference of the casing 110 (to the right in FIG. 3) that presents two elements of the first type 122 (material A) and one element of the second type 124 (material B) that follow one another in the order A B A (going clockwise).

Similarly, the second spatial period W2 of the wave W is associated with the second quarter of the circumference of the casing 110 (at the top in FIG. 3) presenting two elements of the first type 122 (material A) and two elements of the second type 124 (material B) following one another in the order A B A B.

For the third spatial period W3 of the wave W and the third quarter of the circumference of the casing 110 (to the left in FIG. 3), there is a succession of materials B A B, and for the fourth spatial period of the wave W and the fourth quarter of the circumference of the casing 110 (to the bottom in FIG. 3), there is a succession of materials B A B A.

Thus, from this system it can be seen that each spatial period W1 to W4 of the wave W is associated with stiffness of the corresponding angular portion of the casing 110 that is different. As a result, each spatial period W1 to W4 of the wave W propagates at a speed that is different, such that the wave W cannot become installed in the casing 110 or in the bladed wheel 20 phenomena of contact occurring between the rotor and the stator.

Figure 4:
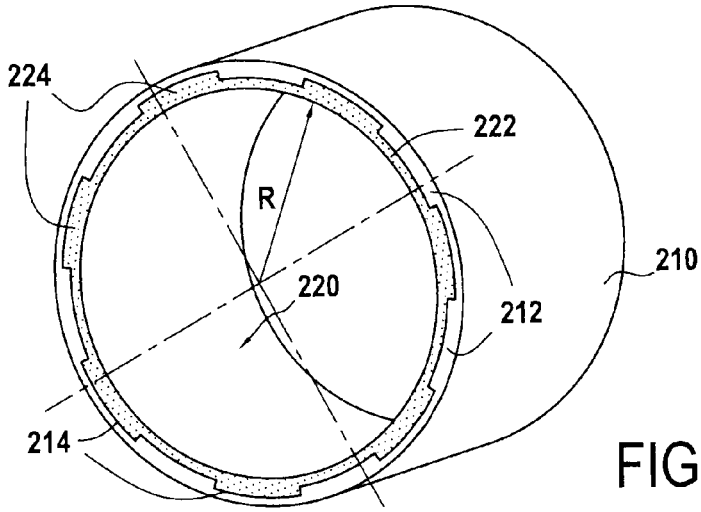
FIG. 4 is a perspective view of a casing for a second embodiment of the invention.

In a second embodiment of the invention as shown in FIG. 4, a sectorized abradable layer 222 is used in which said elements of the first type 222 and elements of the second type 224 are layers of abradable material having thicknesses that are different, being located in angular sectors on the inside face of the casing 210. More precisely, elements of the first type 222 and elements of the second type 224 are selected that are made out of the same material and that therefore have the same Young's modulus, and that are located over the entire inside face of the casing 210.

To do this, in order to ensure that the radial distance R (between the axis of the casing and the inside face of the casing 210 covered in elements of the first type 222 and elements of the second type 224 having different thicknesses) remains constant, a casing 210 is used having an inside face that is crenellated.

More precisely, it is at least the segment of the casing 210 that is to form the track for the bladed wheel 20 that presents an inside face that is crenellated by longitudinal grooves 214 that are regularly spaced apart from one another. An inter-groove spacing is selected to be equal to the angular sector of each longitudinal groove 214. Between two adjacent longitudinal grooves 214, there is therefore formed a longitudinal rib 212 having the same angular extent.

Thus, in this second embodiment of the invention, the inside face of the casing 210 is machined so as to form alternating longitudinal ribs 212 and longitudinal grooves 214, and then the layer of abradable material 220 is deposited.

To do this, it is possible to make a single abradable layer 220 that initially presents thickness that is constant, i.e. that presents crenellated portions in relief constituting an image of the inside surface of the casing 210, which layer is subsequently subjected to surface machining so as to obtain casing housing of radius R.

Alternatively, it is possible to deposit the material forming the elements of the first type 222 and the elements of the second type 224 separately, respectively on the longitudinal ribs 212 and the longitudinal grooves 214 of the inside surface of the casing 210, so that the deposits have directly their final thicknesses that differ between the elements of the first type 222 and the elements of the second type 224. The difference in thickness between the elements of the first type 222 and the elements of the second type 224 is equal to the depth of the longitudinal grooves 214.

Figure 6:
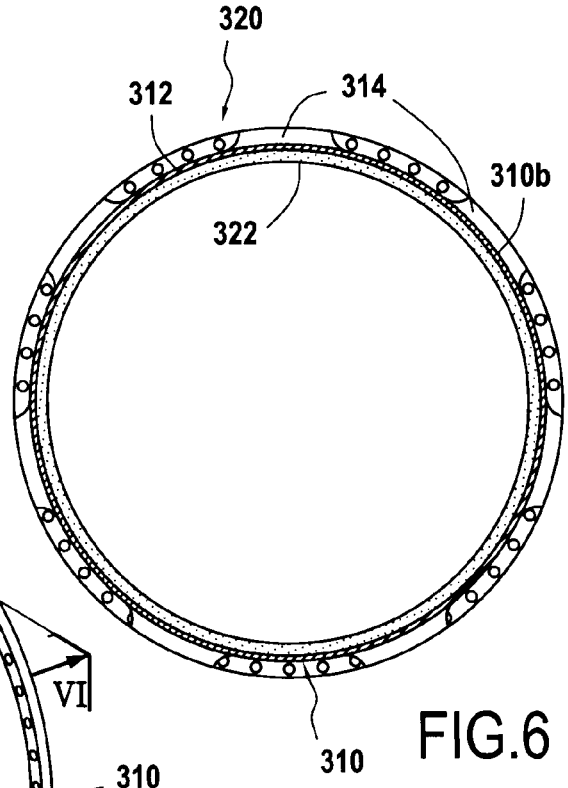
FIG. 6 is a face view in section of the FIG. 5 casing seen looking along direction VI.
Figure 5:
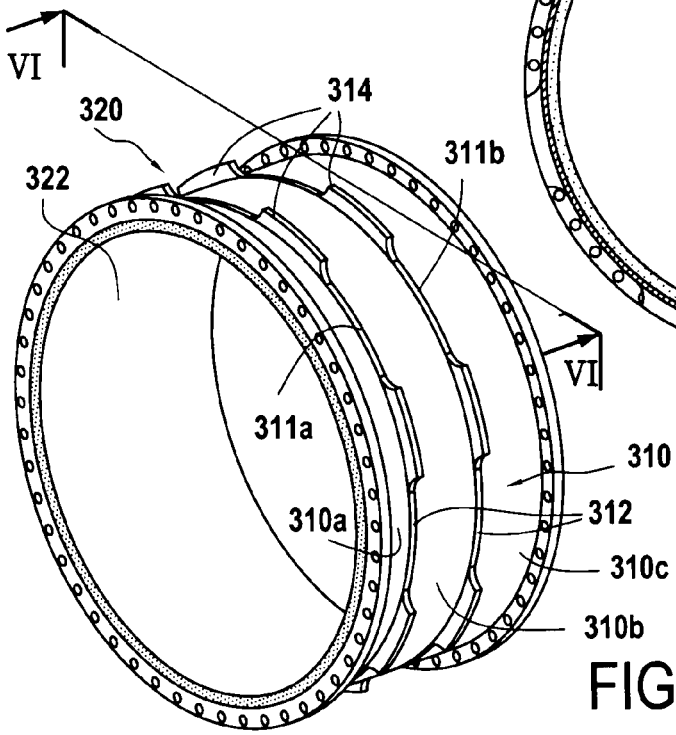
FIG. 5 is a perspective view of a casing for a third embodiment of the invention.

In a third embodiment of the invention, as shown in FIGS. 5 and 6, it is the outside face of the casing 310 that is fitted with an anti-instability device 320 where said elements of the second type are ribs 314 placed in angular sectors that project from the outside face of the casing 310 so as to form lugs acting as stiffeners on the outside face of the casing, which is thus crenellated when seen in face view (FIG. 6).

In the example shown, on the circumference of the casing 310, there are seven ribs 314 alternating with seven rib-less angular sectors 312 forming the elements of the first type of the anti-instability device 320.

To fabricate the casing 310, three casing segments 310*a*, 310*b*, and 310*b* are provided together with two disks 311*a* and 311*b* each located between two adjacent casing segments.

Each disk 311*a* and 311*b* presents an internal opening of diameter equal to the inside diameter of the casing segments 310*a*, 310*b*, and 310*c*, and an outer outline extending between two concentric circles defining respectively the outer outlines of the angular sectors 312 without ribs and of the angular sectors 314 with ribs.

The stack of three casing segments 310*a*, 310*b*, and 310*c* and two disks 311*a* and 311*b* is assembled in such a manner that the ribs 314 of the two disks are in alignment on common angular sectors.

Thus, the ribs 314 extend radially far enough to create the desired stiffness difference between the rib-less angular sectors 312 and the ribbed angular sectors 314. As for the longitudinal extent of the ribs 314 (i.e. in the axial direction of the casing 310), given the implementation using two disks 311*a* and 311*b*, this is restricted to the thickness of the disks 311*a* and 311*b*.

It will be understood that the solution proposed using ribs 314 of small longitudinal extent serves to avoid making the casing too heavy. Nevertheless, instead of having ribs 314 of small longitudinal extent, it would be possible to provide projecting elements that extend over all or a large fraction of the length of the casing.

Figure 1:
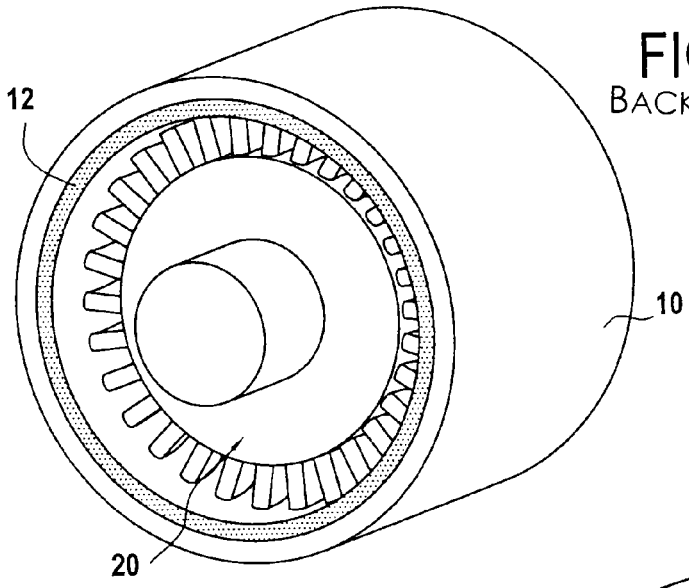
FIG.1 BACKGROUND ART
FIG. 1, described above, is a perspective view of a bladed wheel mounted in its casing in conventional manner.

In the third embodiment, the inside face of the casing is coated with a continuous layer of abradable material 322 of constant thickness that is made of a single material, identical to the layer 12 of the prior art casing 10 shown in FIG. 1.

It will be understood that in the third embodiment, unlike the first embodiment and second embodiment as described above, it is not the layer of abradable material 322 that provides the anti-instability device, but rather it is the casing 310 with angular sectors of different stiffnesses that provides it.

It will thus be understood that by selecting elements of the first type and elements of the second type for the device of the invention forming part of the casing associated with a bladed wheel, to be present in numbers that are not a multiple of the wave number of the vibratory mode of the bladed wheel that is to be inhibited, any propagation of this vibratory mode to the casing 110, 210, or 310, or within the bladed wheel 20, is prevented during phenomena of contact being made between the rotor and the stator.

These embodiments relate merely to one particular wave W (having a wave number equal to four) and one particular number of elements of the first type and elements of the second type (i.e. seven of each), for the associated anti-instability device.

More generally, it is necessary to adapt the succession of elements of the first type and elements of the second type, i.e. the number thereof and the individual angular extent thereof, so as to constitute a pattern that is adapted to the wave number of the vibratory mode(s) of the rotor that it is desired to disturb.

What is claimed is:

1. A cylindrical casing for a turbomachine, suitable for receiving a rotor fitted with at least one bladed wheel, the cylindrical casing comprising, at a location suitable for being situated in register with the bladed wheel, a device for preventing instability during contact between the casing and the bladed wheel, wherein said device includes a succession of elements disposed along the circumference of the casing and presenting, between two adjacent elements stiffnesses that are different, the number of two adjacent elements of the same stiffness not being equal to a multiple of the wave number of the vibratory mode of the bladed wheel that is to be inhibited.

2. The cylindrical casing according to claim 1, wherein said device comprises elements of a first type presenting a first stiffness and elements of a second type presenting a second stiffness different from the first stiffness.

3. The cylindrical casing according to claim 2, wherein said elements of the first type and of the second type are layers of abradable material having different Young's moduluses, disposed in angular sectors on the inside face of the cylindrical casing.

4. The cylindrical casing according to claim 2, wherein said elements of the first type and said elements of the second type are layers of abradable material of different thicknesses, disposed in angular sectors on the inside face of the cylindrical casing.

5. The cylindrical casing according to claim 2, wherein said elements of the second type are ribs disposed in angular sectors and projecting from the outside face of the cylindrical casing.

6. The cylindrical casing according to claim 1, wherein the elements of the first type present a first angular sector size and the elements of the second type present a second angular sector size, and wherein the first angular sector size and the second angular sector size are identical.

7. The cylindrical casing according to claim 1, wherein the elements of the first type present a first angular sector size and the elements of the second type present a second angular sector size, and wherein the first angular sector size and the second angular sector size are different.

8. A rotor and stator assembly comprising a cylindrical casing according to claim 1 forming the stator and a bladed wheel forming the rotor, wherein the cylindrical casing includes, at a location situated in register with the bladed wheel, a device preventing instability during contact between the casing and the bladed wheel.

9. The rotor and stator assembly according to claim 8, wherein said bladed wheel is a one-piece bladed disk or a one-piece bladed ring.

10. A compressor including, as its stator, a cylindrical casing according to claim 1.

11. A turbomachine, including a compressor according to claim 10.

12. A fan including, as its stator, a cylindrical casing according to claim 1.

13. A turbomachine, including a fan according to claim 12.

14. A turbine, including as a stator, a cylindrical casing according to claim 1.

15. A turbomachine, including a turbine according to claim 14.

16. A method of preventing instability appearing during contact in a stator and rotor assembly of a turbomachine, the method consisting in inhibiting at least one vibratory mode of a bladed wheel forming part of the rotor, wherein the method consists in arranging a cylindrical casing at a location situated in register with the bladed wheel in such a manner that the cylindrical casing, along its circumference, presents angular sectors of different stiffnesses, the numbers of angular sectors having the same stiffness not being equal to a multiple of a wave number of the vibratory mode of the bladed wheel that is to be inhibited.

* * * * *